US007690954B2

(12) United States Patent
Watanabe et al.

(10) Patent No.: US 7,690,954 B2
(45) Date of Patent: Apr. 6, 2010

(54) CONNECTOR TERMINAL HAVING ELECTRICAL WIRE AND CONNECTOR RECEIVING THE SAME

(75) Inventors: Jin Watanabe, Aichi (JP); Yasuyuki Kugimiya, Aichi (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/318,472

(22) Filed: Dec. 30, 2008

(65) Prior Publication Data

US 2009/0186507 A1 Jul. 23, 2009

(30) Foreign Application Priority Data

Jan. 23, 2008 (JP) ..... 2008-013058

(51) Int. Cl.
*H01R 4/18* (2006.01)

(52) U.S. Cl. ..... 439/730

(58) Field of Classification Search ..... 439/730, 439/932, 585, 578; 174/DIG. 8
See application file for complete search history.

(56) References Cited

U.S. PATENT DOCUMENTS 4,249,790 A * 2/1981 Ito et al. ..... 439/583
5,123,864 A * 6/1992 Karlovich ..... 439/585

FOREIGN PATENT DOCUMENTS

| | | |
|---|---|---|
| JP | 04-111160 | 9/1992 |
| JP | 06-333628 | 12/1994 |
| JP | 07-211381 | 8/1995 |

* cited by examiner

*Primary Examiner*—Phuong K Dinh
(74) *Attorney, Agent, or Firm*—Edwards Angell Palmer & Dodge LLP

(57) ABSTRACT

The present invention is to provide a connector terminal, which is crimp connected with an aluminum or aluminum alloy conductor having a large diameter, to be inserted into a terminal receiving chamber of a conventional connector housing designed for a copper conductor with less change of electrical characteristic and less modification. The connector terminal having the conductor of the present invention is widely adapted to a vehicle. The connector terminal crimping the electrical wire has a link portion longer than a link portion of a standard connector terminal so that an electrical wire crimp portion projects outwardly from a rearward face when the connector terminal is received in the connector housing. An insulation crimp portion is positioned spaced apart from the rearward face of the connector housing to prevent physical interference with the connector housing.

8 Claims, 4 Drawing Sheets

CONNECTOR TERMINAL HAVING ELECTRICAL WIRE AND CONNECTOR RECEIVING THE SAME

BACKGROUND OF THE INVENTION

1. Field of the Invention

The present invention relates to a connector terminal having an electrical wire, and relates to a connector receiving the connector terminal. More specifically, the present invention relates to a connector terminal, which crimps an electrical wire having an aluminum conductor of a diameter larger than a copper conductor, to be inserted into a conventional connector housing designed for an electrical wire having the copper conductor, and relates to a connector receiving the connector terminal having the aluminum conductor.

2. Description of the Related Art

A wiring harness arranged in a motor vehicle generally utilizes the electrical wire having the copper conductor for reasons of low cost and good electrical conductivity. The electrical wire having the aluminum conductor, also including an aluminum alloy conductor, is not usually utilized for reasons of less conductivity and less strength. However, recent environmental issues demand a lightweight of the motor vehicle for fuel-efficiency, and the lightweight of the motor vehicle is achieved by utilizing the aluminum conductor in place of the copper conductor.

Electrical parts, such as the connector terminal received in the connector housing, utilized in the motor vehicle are mainly designed for the copper conductor instead of the aluminum conductor. Electronic devices are also designed for the copper conductor and are not considered about connection with the aluminum conductor. It is desirable that the aluminum conductor is adapted to all of the electrical parts of the motor vehicle. However, it is not practical with respect to product cost.

The electrical wire having the aluminum conductor has a conductivity lower than the electrical wire having the copper conductor and it is thus necessary to utilize the aluminum conductor of a large diameter in order to achieve the same electrical characteristic as the copper conductor. Since the connector housing of the connector utilized in the motor vehicle is mainly designed for the electrical wire having the copper conductor, it is thus difficult to utilize the electrical wire having the aluminum conductor for reason of the shape of the connector housing. When the connector terminal crimping the electrical wire having the aluminum conductor is inserted into a terminal receiving chamber of the connector housing, the electrical wire itself or an electrical wire crimp portion crimping an end portion of the electrical wire interferes with an end face of the connector housing and prevents entrance of the connector terminal into the connector housing.

JP,H06-333628,A discloses a joint connector to receive terminals having electrical wires of different diameters, the terminals having the same shape of terminal contact portions. The joint connector includes a plurality of connector housings, which have a small terminal receiving chamber to receive the terminal having the electrical wire of a small diameter and a large terminal receiving chamber to receive the terminal having the electrical wire of a large diameter.

When the joint connector of JP,H06-333628,A is utilized in the motor vehicle, it is necessary to replace the existing parts such as connector housing and connector terminal with the parts prepared for the electrical wire having the aluminum conductor of the large diameter. The terminal receiving chambers of the joint connector restrict the size of the connector terminal.

SUMMARY OF THE INVENTION

An object of the present invention is to provide a connector terminal, which crimps an electrical wire having an aluminum or aluminum alloy conductor of a large diameter, to be inserted into a terminal receiving chamber of a conventional connector housing designed for an electrical wire having a copper conductor with less change of electrical property and less modification and be adapted for a motor vehicle. The connector terminal including the aluminum conductor thus reduces cost and achieves the lightweight of the motor vehicle, resulting in fuel-efficiency.

According to a first aspect of the present invention, a connector terminal having an electrical wire includes: a main body formed from a conductive metal; a terminal contact portion disposed forward of the main body for being electrically connected to a mating terminal; an electrical wire crimp portion disposed rearward of the main body for crimping an end portion of the electrical wire and being electrically connected to a conductor; and a link portion formed on the main body for linking between the terminal contact portion and the electrical wire crimp portion, wherein the link portion is extended so that when the connector terminal is inserted through a terminal insertion opening of a terminal receiving chamber of a connector housing and the main body is received in the terminal receiving chamber, the electrical wire crimp portion projects from a rearward face of the connector housing and the projected portion is covered with an insulation sheath.

Thereby, the electrical wire crimp portion projects from the rearward face of the connector housing when the main body of the connector terminal is received in the terminal receiving chamber. When the conventional connector terminal crimping the electrical wire having the aluminum conductor of the large diameter is inserted into the terminal receiving chamber, a part of the electrical wire or the electrical wire crimp portion interferes with the rearward face of the connector housing. The interference portion is positioned spaced apart from the rearward face of the connector housing, and the connector terminal including the aluminum conductor is thus received in the terminal receiving chamber of the conventional connector housing designed for the copper conductor. The electrical wire crimp portion projecting from the rearward face of the connector housing is covered with the insulation sheath to prevent electrical contact between the connector terminals or electrical parts such as the electrical wires and provide a crosswise strength against the insertion direction and a tensile strength in the insertion direction. The electrical wire having the aluminum conductor is accordingly utilized in the motor vehicle with less change of the electrical characteristic and less modification, and reduces cost and achieves the lightweight of the motor vehicle, resulting in the fuel-efficiency. The conventional connector housing can thus receive the connector terminal including the aluminum conductor as well as the conventional connector including the copper conductor.

Preferably, the central line of the electrical wire crimp portion in an insertion direction of the connector terminal is shifted with respect to the central line of the terminal contact portion in the insertion direction.

Thereby, when the plurality of the connector terminals are adjacently received in the terminal receiving chambers, the physical interference and the electrical contact between the electrical wire crimp portions are prevented and the connector terminals are assuredly inserted into the terminal receiving chambers with electrical safety.

Preferably, the conductor is aluminum or an aluminum alloy.

Thereby, the connector terminal achieves a lightweight of the wiring harness arranged in the motor vehicle, resulting in the fuel-efficiency.

According to a second aspect of the present invention, a connector including: a connector housing having a terminal receiving chamber; and a connector terminal having an electrical wire to be inserted through a terminal insertion opening disposed on a rearward face of the connector housing, the connector terminal including a main body formed from a conductive metal, a terminal contact portion disposed forward of the main body for being electrically connected to a mating terminal, an electrical wire crimp portion disposed rearward of the main body for crimping an end portion of the electrical wire and being electrically connected to a conductor, and a link portion formed on the main body for liking between the terminal contact portion and the electrical wire crimp portion, wherein the link portion is extended so that when the main body of the connector terminal is received in the terminal receiving chamber of the connector housing, the electrical wire crimp portion projects from a rearward face of the connector housing, and the projected portion is covered with an insulation sheath.

Thereby, the electrical wire crimp portion projects from the rearward face of the connector housing when the main body of the connector terminal is received in the terminal receiving chamber. When the conventional connector terminal crimping the electrical wire having the aluminum conductor of the large diameter is inserted into the terminal receiving chamber, a part of the electrical wire or the electrical wire crimp portion interferes with the rearward face of the connector housing. The interference portion is positioned spaced apart from the rearward face of the connector housing, and the connector terminal including the aluminum conductor is thus received in the terminal receiving chamber of the conventional connector housing designed for the copper conductor. Use of the electrical wire having the aluminum conductor for the wiring harness of the motor vehicle prevents increase of product cost.

Preferably, the central line of the electrical wire crimp portion in an insertion direction of the connector terminal is shifted with respect to the central line of the terminal contact portion in the insertion direction.

Thereby, when the plurality of the connector terminals are adjacently received in the terminal receiving chambers, the physical interference and the electrical contact between the electrical wire crimp portions are prevented.

Preferably, the conductor is aluminum or an aluminum alloy.

Thereby, the connector terminal achieves the lightweight of the wiring harness arranged in the motor vehicle, resulting in the fuel-efficiency.

DETAILED DESCRIPTION OF THE PREFERRED EMBODIMENTS

First Embodiment

Figure 1A:
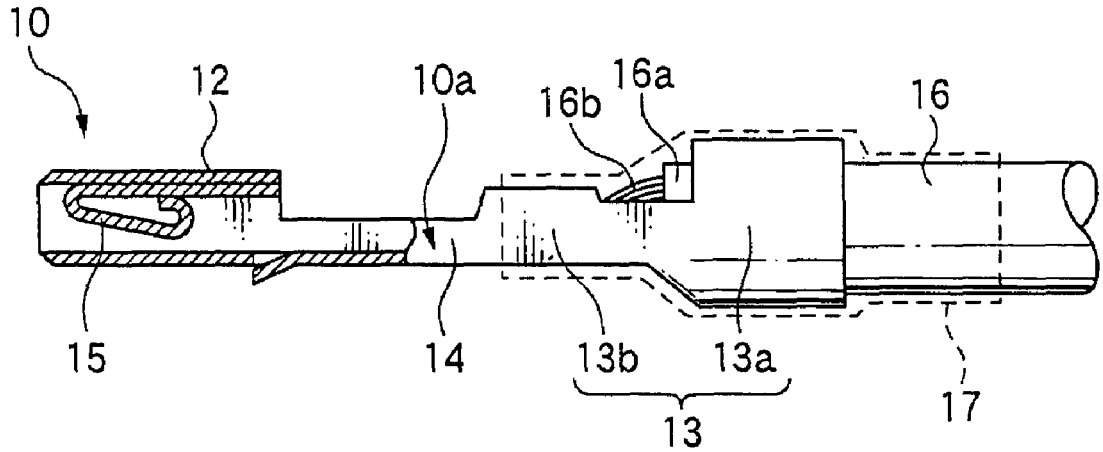
FIG. 1A is a side view, partly exploded, of a first embodiment of a connector terminal having an electrical wire of the present invention.
Figure 1B:
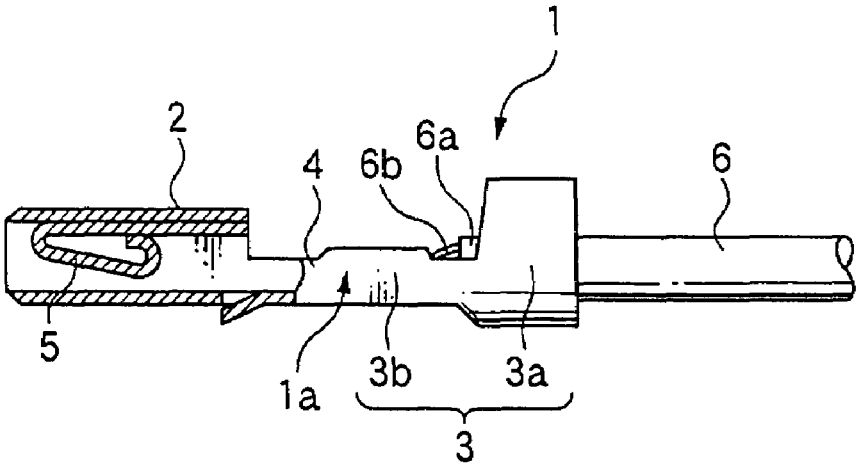
FIG. 1B PRIOR ART
FIG. 1B is a side view, partly exploded, of a standard connector terminal having an electrical wire.
Figure 2:
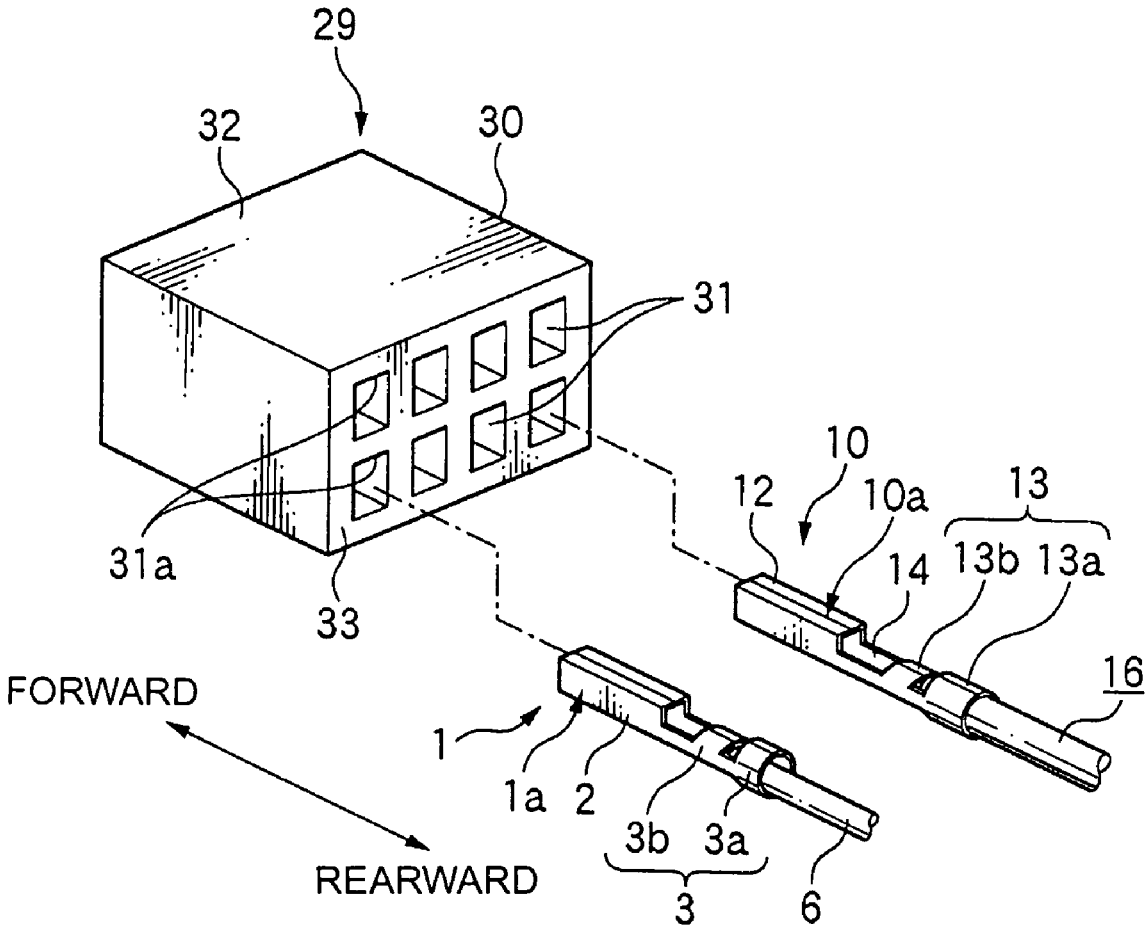
FIG. 2 is a perspective view of a connector having a conventional connector housing to receive the connector terminal of the present invention and the standard connector terminal.
Figure 3:
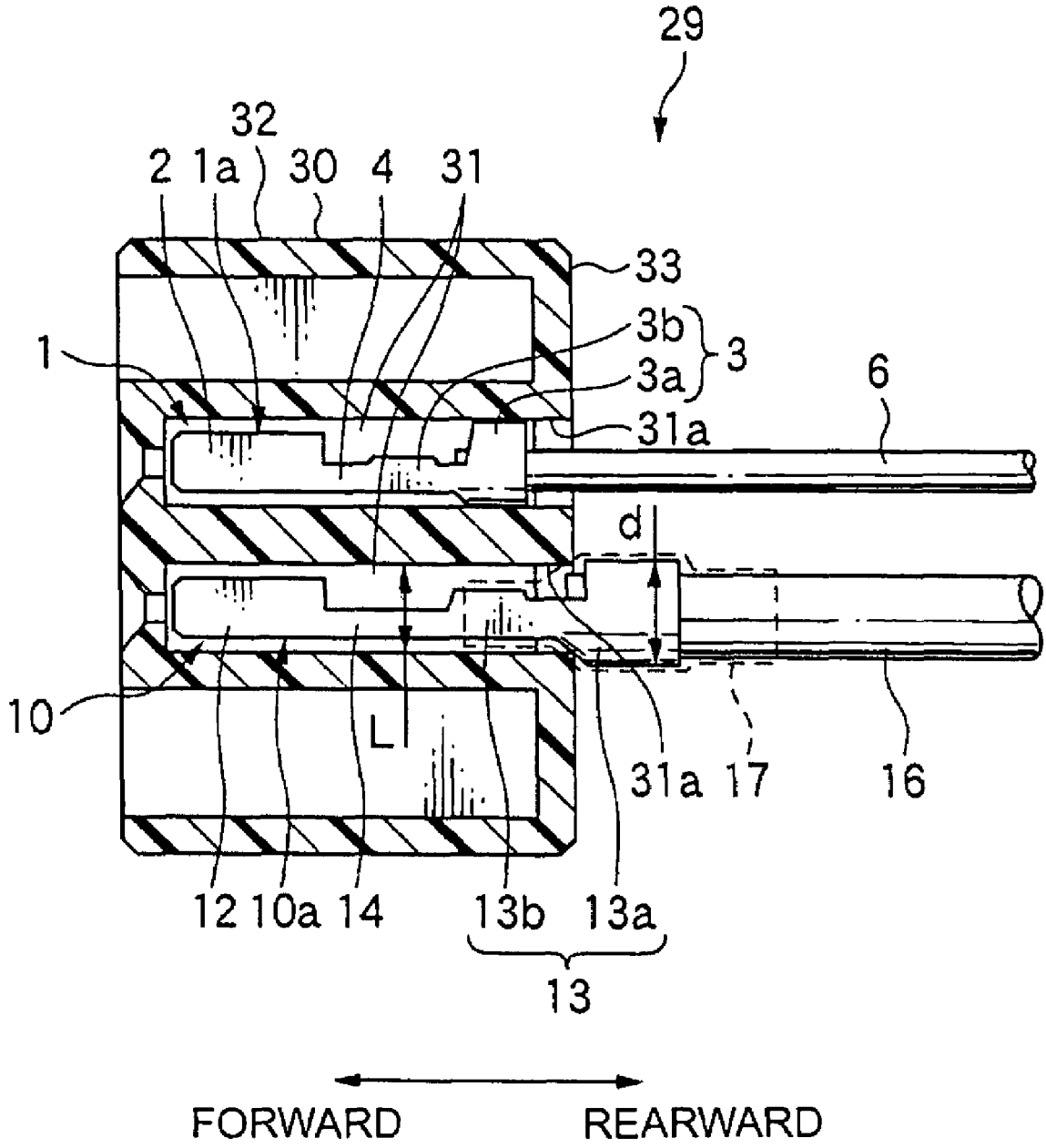
FIG. 3 is a cross-sectional view of the connector having the conventional connector housing receiving the connector terminal of the present invention and the standard connector terminal.

FIG. 1A is a side view, partly exploded, of a connector terminal 10 having an electrical wire 16 of a first embodiment of the present invention, and FIG. 1B is a side view, partly exploded, of a conventional connector terminal 1 having an electrical wire 6. FIG. 2 is a perspective view of a connector 29 having a conventional connector housing 30 to receive the connector terminal 10 of the present invention and the conventional connector terminal 1. FIG. 3 is a cross-sectional view of the connector 29 having the connector housing 30 receiving the connector terminal 16 of the present invention and the conventional connector terminal 6.

The connector terminal 1 having the electrical wire 6, hereinafter simply referred to the connector terminal, utilized for a motor vehicle is explained. Electrical wires utilized in the motor vehicle or home electric appliances generally have conductors such as copper materials. The electrical wire having the copper conductor is thus referred to a standard electrical wire and the connector terminal connected with the standard electrical wire is referred to a standard connector terminal.

Referring to FIG. 1B, the standard connector terminal 1 includes a main body 1*a*, a terminal contact portion 2 disposed forwardly of the main body 1*a* to contact a mating terminal (not shown) via a contact piece 5, an electrical wire crimp portion 3 disposed rearwardly of the main body 1*a* to crimp one end portion of the standard electrical wire 6, and a link portion 4 with a U-shaped cross section, formed on the main body 1*a* to link between the terminal contact portion 2 and the electrical wire crimp portion 3. The standard connector terminal is integrally press formed from a conductive metal or a plated metal such as copper or a copper alloy. The electrical wire crimp portion 3 has an insulation crimp portion 3*a* to crimp an insulation 6*a* of the standard electrical wire 6, and a conductor crimp portion 3*b* to crimp a conductor 6*b* exposed from the insulation 6*a* of an end portion of the electrical wire 6. The electrical wire crimp portion 3 has also a U-shaped cross section.

The connector terminal 10 of the present invention has the electrical wire 16 having aluminum or an aluminum alloy conductor 16*b* in place of the standard electrical wire 6 to achieve a lightweight wiring harness wired in a vehicle. The electrical wire 16 of the present invention has the aluminum or aluminum alloy conductor 16*b* with a density of 2.70 g/cm$^3$, which is about a third of a density of 8.96 g/cm$^3$ of copper, and thus achieves the significant lightweight wiring harness. Aluminum has a conductivity lower than copper and it is thus necessary that a diameter of the aluminum conductor is about 1.6 times larger than the copper conductor to keep the same electrical characteristic (allowable load current) as the copper.

Referring to FIG. 1A, the connector terminal 10 of the present invention has the electrical wire 16 having the aluminum conductor 16*b*, the diameter of which is larger than the standard electrical wire 6. The connector terminal 10 includes a main body 10*a*, a terminal contact portion 12 disposed forwardly of the main body 10*a* to contact a mating terminal (not shown) via a contact piece 15, an electrical wire crimp portion 13 disposed rearwardly of the main body 10*a* to crimp one end portion of the electrical wire 16 having the aluminum conductor 16*b*, and a link portion 14 with a U-shaped cross section, formed on the main body 10*a* to link between the terminal contact portion 12 and the electrical wire crimp portion 13. The connector terminal 10 is integrally press formed from a conductive metal or a plated metal such as copper or a copper alloy, similarly to the standard connector terminal 1.

The terminal contact portion 12 has a rectangular cross-section and has the resilient U-shaped contact piece 15 on an inner wall thereof. The contact piece 15 ensures contact of the mating terminal (not shown) with a low electrical resistance. The terminal contact portion 12 of the present invention has the same shape and size as the terminal contact portion 2 of the standard connector terminal 1. Both the terminal contact portions 2 and 12 can be thus received in terminal receiving chambers 31 of the connector housing 30 (refer to FIG. 2) to be mated to the same type mating terminals.

The electrical wire crimp portion 13 has an insulation crimp portion 13*a* to crimp an insulation 16*a* of the electrical wire 16 having the aluminum conductor 16*b*, and a conductor crimp portion 13*b* to crimp the aluminum conductor 16*b* exposed from the insulation 16*a* of an end portion of the electrical wire 16. The electrical wire crimp portion 13 is formed in a U-shape. The electrical wire crimp portion 13 of the connector terminal 10 of the present invention is larger than that of the standard connector terminal 1 (refer to FIGS. 1A and 1B) in order to crimp the electrical wire 16 with the diameter larger than that of the standard electrical wire 6.

The electrical wire 16 is crimped with the electrical wire crimp portion 13 in a manner that the electrical wire 16 is lengthwise positioned on the electrical wire crimp portion 13, and the insulation crimp portion 13*a* and the conductor crimp portion 13*b* are crimped onto the insulation 16*a* and the aluminum conductor 16, respectively to hold the electrical wire 16 and electrically connect the connector terminal 10 to the conductor 16*b*, respectively.

The link portion 14 is formed on the main body 10*a* and has a U-shape to link between the terminal contact portion 12 and the electrical wire crimp portion 13. The link portion 14 of the connector terminal 10 of the present invention is longitudinally longer than the link portion 4 of the standard connector terminal 1. The connector terminal 10 of the present invention is designed in a way that the electrical wire crimp portion 13 projects from a rearward face 33 of the connector housing 30 when the main body 10*a* of the connector terminal 10 is received in the connector housing 30.

The electrical wire crimp portion 13 crimping the end portion of the electrical wire 16 is covered with a heat-shrinkable tube (insulation sheath) 17 together with the end portion of the electrical wire 16 in a way that the electrical wire 16 is first inserted into the insulation sheath 17, and the insulation sheath is moved to a connected portion between the electrical wire crimp portion 13 and the electrical wire 16, and is heat shrink fitted to the connected portion. The insulation crimp portion 13*a* projecting from the rearward face 33 is thus covered with the insulation sheath 17.

The connector 29 of the present invention includes the connector housing 30 receiving the connector terminal 10 and the standard connector terminal 1. The connector housing 30 is injection molded with a synthetic resin such as PBT (polybutylene terephthalate) and has a rectangular tube shape. The connector housing 30 includes a plurality of the terminal receiving chambers 31 vertically and horizontally disposed, 2 times 4 in FIG. 2, in a space defined by an outer wall 32 of the connector 29. The terminal receiving chambers 31 each have an associated terminal insertion opening 31*a* to receive the standard connector terminal 1 and the connector terminal 10 of the present invention. The terminal contact portions 12 and 2 of the connector terminals 10 and 2 are inserted into the terminal insertion openings 31 disposed rearward of the connector housing 30, and the main bodies 10*a* and 1*a* are received in the connector housing 30.

The connector housing 30 of FIGS. 2 and 3 is the standard connector housing 30 having the terminal receiving chambers 31 to receive the standard connector terminals 1. Referring to FIG. 3, a length L of a side of each terminal insertion opening 31*a* is smaller than a diameter d of the insulation crimp portion 13*a*.

The link portion 14 of the connector terminal 10 of the present invention is longer than the link portion 4 of the standard connector terminal 1 and the electrical wire crimp portion 13 projects from the rearward face 33 of the connector housing 30 so that the insulation crimp portion 13*a* is positioned spaced apart from the rearward face 33 so as to prevent physical interference such as contact between a forward end of the insulation crimp portion 13*a* and the rearward face 33 of the connector housing 30.

The connector terminal 10 having the electrical wire 16 with the large diameter of the aluminum conductor can thus be inserted into the conventional connector housing 30 designed for the standard electrical wire 6. The insulation crimp portion 13*a* spaced apart from the rearward face 33 of the connector housing 30 is covered with the heat-shrinkable tube 17 together with the end portion of the electrical wire 16, so that electrical contact between the adjacent standard electrical wire 6 and the adjacent electrical wire 16 is thus prevented. The sheath 17 provides strength in a lateral and insertion direction of the connector terminal 10.

The electrical wire 16 having the aluminum conductor 16*b* can thus be utilized in the vehicle to reduce cost and weight of the vehicle, resulting in low fuel consumption of the motor vehicle with less change of the electrical characteristic and less modification. The connector housing 30 of the connector 29 accepts both the standard connector terminal 1 and the connector terminal 10 of the present invention and reduces cost of the product.

Second Embodiment

Figure 4:
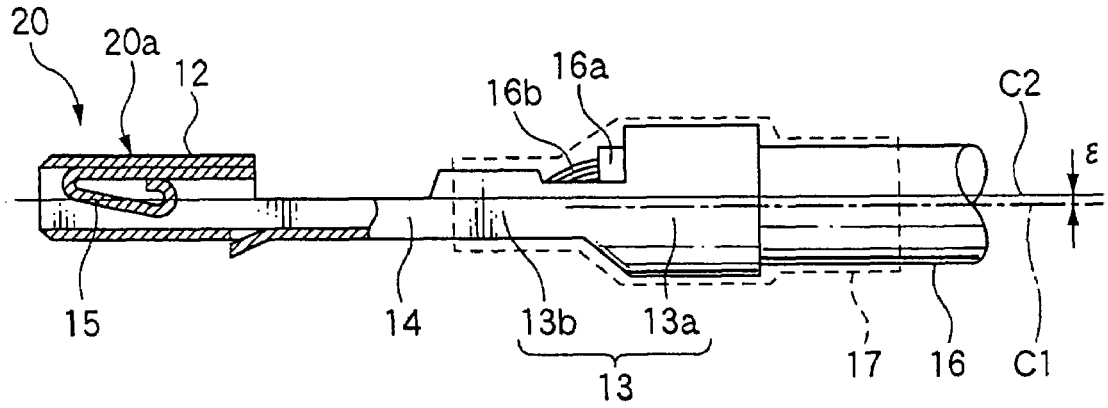
FIG. 4 is a side view, partly exploded, of a second embodiment of a connector terminal having an electrical wire of the present invention.
Figure 5:
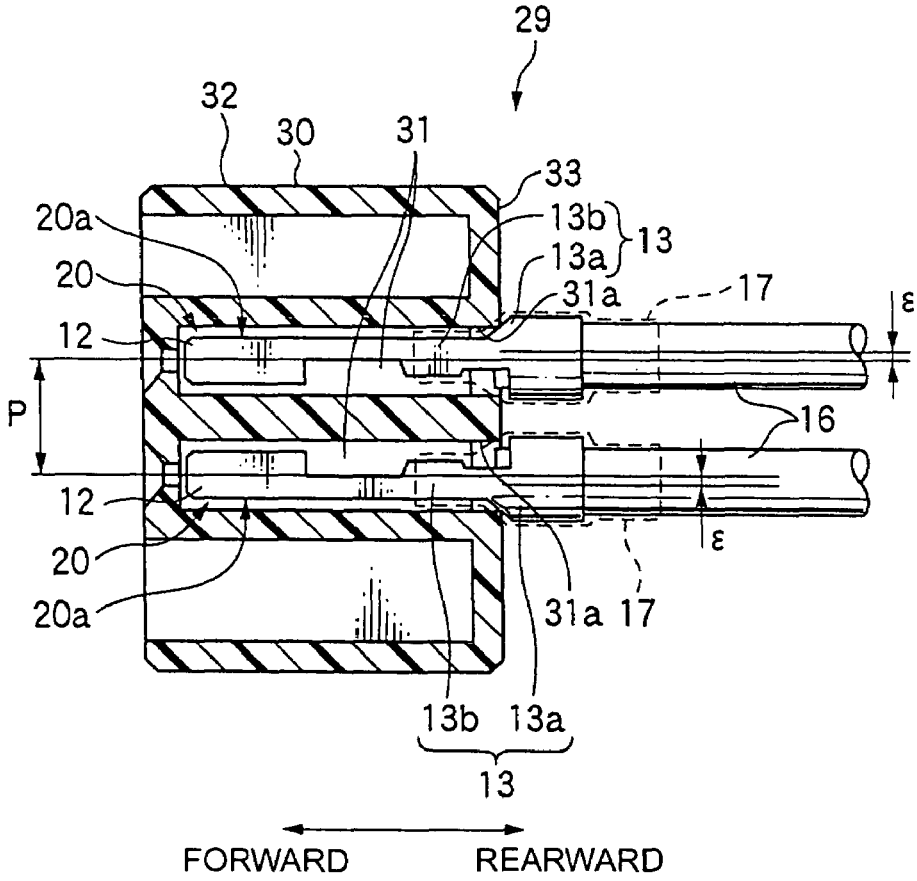
FIG. 5 is a cross-sectional view of the connector receiving the connector terminals having the electrical wires of the present invention, the connector terminals being adjacently received in terminal receiving chambers of the connector housing.

FIGS. 4 and 5 show a second embodiment of the present invention. FIG. 4 is a side view, partly exploded, of the second embodiment of a connector terminal 20 and FIG. 5 is a cross-sectional view of the connector 29 receiving the adjacent connector terminals 20 in the connector housing 30. The only difference between the first embodiment and the second embodiment is that the central line C1 of the electrical wire crimp portion 13 is shifted with respect to the central line C2 of the terminal contact portion 12. Like parts as the first embodiment have the same signs and the explanations thereof are omitted.

Referring to FIG. 4, the connector terminal 20 of the present invention has the terminal contact portion 12, the electrical wire crimp portion 13 and the link portion 14. The terminal contact portion 12 has the same shape as the terminal contact potion 2 of the standard connector terminal 1. The electrical wire crimp portion 13 has the insulation crimp portion 13*a* and the conductor crimp portion 13*b*, and is formed in a size larger than the electrical wire crimp portion 3 of the standard connector terminal 1 in order to crimp the aluminum conductor 16 having the large diameter.

The central line C1 of the insulation crimp portion 13*a* is shifted by an amount of ϵ with respect to the central line C2 of the terminal contact portion 12. The link portion 14 is formed on the main body 20*a* to link between the terminal contact portion 12 and the electrical wire crimp portion 13, and designed in a way that the electrical wire crimp portion 13 projects from the connector housing 30 when the connector terminal 20 is received in the connector housing 30.

The conductor 16*b* is crimped with the conductor crimp portion 13*b* and the insulation 16*a* is crimped with the insulation crimp portion 13*a*. The electrical wire crimp portion 13 is then covered with the insulation sheath 17 together with the end portion of the electrical wire 16.

When the connector terminal 20 is received in the terminal receiving chamber 31 of the connector housing 30 designed for the standard electrical wire 6, the insulation crimp portion 13*a* of the electrical wire crimp portion 13 is positioned spaced apart from the rearward face 33 to prevent physical interference with the connector housing 30 and ensure insertion of the connector terminal 20 having the aluminum conductor 16*b* with the large diameter.

Even though a distance P between the central lines of the terminal receiving chambers 31 is smaller than the diameter d of the electrical wire crimp portion 13 or the insulation crimp portion 13*a*, the connector terminals 20 can be inserted into the terminal receiving chambers 31 in a way that the connector terminals 20 each are inserted into the associated terminal receiving chamber 31 with mirror relation one to the other. The electrical wire crimp portions 13 are positioned spaced apart by the amount of 2ϵ so that the physical interference and electrical contact between the electrical wire crimp portions 13 can be prevented. The connector terminal 20 having the aluminum conductor of the large diameter can thus be easily inserted into the connector housing 30.

The present invention is not limited to the embodiments described in the specification, and modification and alteration thereof are within the scope of the present invention. For example, the present invention is also adapted to male terminal. If the link portion is further extended and the conductor crimp portion is positioned outside of the connector housing, the connector terminal is capable of crimping the aluminum conductor having the size larger than the terminal receiving chamber.

What is claimed is:

1. A connector terminal having an electrical wire comprising:

a main body formed from a conductive metal;

a terminal contact portion disposed forward of the main body for being electrically connected to a mating terminal;

an electrical wire crimp portion disposed rearward of the main body for crimping an end portion of the electrical wire and being electrically connected to a conductor; and a link portion formed on the main body for linking between the terminal contact portion and the electrical wire crimp portion, wherein the link portion is extended so that when the connector terminal is inserted through a terminal insertion opening of a terminal receiving chamber of a connector housing and the main body is received in the terminal receiving chamber, the electrical wire crimp portion projects from a rearward face of the connector housing and the projected portion is covered with an insulation sheath.

2. The connector terminal having the electrical wire as claimed in claim 1, wherein the central line of the electrical wire crimp portion in an insertion direction of the connector terminal is shifted with respect to the central line of the terminal contact portion in a direction transverse to the insertion direction.

3. The connector terminal having the electrical wire as claimed in claim 1, wherein the conductor is aluminum or an aluminum alloy.

4. A connector comprising:

a connector housing having a terminal receiving chamber; and a connector terminal having an electrical wire to be inserted through a terminal insertion opening disposed on a rearward face of the connector housing, the connector terminal including a main body formed from a conductive metal, a terminal contact portion disposed forward of the main body for being electrically connected to a mating terminal, an electrical wire crimp portion disposed rearward of the main body for crimping an end portion of the electrical wire and being electrically connected to a conductor, and a link portion formed on the main body for liking between the terminal contact portion and the electrical wire crimp portion, wherein the link portion is extended so that when the main body of the connector terminal is received in the terminal receiving chamber of the connector housing, the electrical wire crimp portion projects from a rearward face of the connector housing and the projected portion is covered with an insulation sheath.

5. The connector as claimed in claim 4, wherein the central line of the electrical wire crimp portion in an insertion direction of the connector terminal is shifted with respect to the central line of the terminal contact portion in a direction transverse to the insertion direction.

6. The connector as claimed in claim 4, wherein the conductor is aluminum or an aluminum alloy.

7. The connector terminal having the electrical wire as claimed in claim 2, wherein the conductor is aluminum or an aluminum alloy.

8. The connector as claimed in claim 5, wherein the conductor is aluminum or an aluminum alloy.

* * * * *